US006250027B1

(12) United States Patent
Richards

(10) Patent No.: US 6,250,027 B1
(45) Date of Patent: Jun. 26, 2001

(54) GLAZING ELEMENT

(76) Inventor: Paul Anthony Michael Richards, 41 West Broadway, Henleaze, Bristol, BS9 4TD (GB)

( * ) Notice: Subject to any disclaimer, the term of this patent is extended or adjusted under 35 U.S.C. 154(b) by 0 days.

(21) Appl. No.: 09/075,500

(22) Filed: May 8, 1998

(51) Int. Cl.[7] ..... E06B 3/66; B44F 1/06; B44F 1/08

(52) U.S. Cl. ..... 52/204.59; 52/204.59; 52/204.593; 52/314; 52/786.11; 52/786.13; 52/789.1; 52/745.9

(58) Field of Search ..... 52/786.11, 786.1, 52/786.13, 788.1, 789.1, 663, 316, 314, 311.3, 204.59, 204.593, 745.9; 428/34, 38

(56) References Cited

U.S. PATENT DOCUMENTS

| | | | | |
|---|---|---|---|---|
| 1,988,964 | * | 1/1935 | Barrows | 52/786.11 X |
| 3,220,065 | * | 11/1965 | Graham . | |
| 3,661,613 | * | 5/1972 | Contrael et al. | 52/786.1 X |
| 3,797,904 | * | 3/1974 | Krauth | 52/316 X |
| 4,198,796 | * | 4/1980 | Foster | 52/786.11 |
| 4,368,226 | * | 1/1983 | Mucaria . | |
| 4,518,446 | * | 5/1985 | Drennan | 52/786.1 X |
| 4,671,031 | * | 6/1987 | Intengan | 52/789.1 X |
| 4,760,679 | * | 8/1988 | Thompson | 52/630 X |
| 4,791,010 | * | 12/1988 | Hanely et al. . | |
| 4,814,213 | * | 3/1989 | Thron | 52/786.1 X |
| 5,352,532 | * | 10/1994 | Kline | 52/786.1 |
| 5,598,667 | * | 2/1997 | Dykes | 52/316 |
| 5,784,853 | * | 7/1998 | Hood et al. . | |
| 5,794,404 | * | 8/1998 | Kim | 52/786.13 |
| 5,843,546 | * | 12/1998 | Eichhorn | 52/786.1 |
| 5,983,593 | * | 11/1999 | Carbary et al. . | |

FOREIGN PATENT DOCUMENTS

| | | | |
|---|---|---|---|
| 0 008 718 A1 | | 3/1980 | (EP) . |
| 0 031 914 A1 | | 7/1981 | (EP) . |
| 2335662 | * | 7/1977 | (FR) . |
| 1 194 724 | | 6/1970 | (GB) . |
| 1 491 673 | | 11/1977 | (GB) . |
| 2 023 702 | | 1/1980 | (GB) . |
| 2 164 692 | | 3/1986 | (GB) . |
| 2 297 986 | | 8/1996 | (GB) . |

* cited by examiner

*Primary Examiner*—Robert Canfield
(74) *Attorney, Agent, or Firm*—Gifford, Krass, Groh, Sprinkle, Anderson & Citkowski, P.C.

(57) ABSTRACT

A glazing element for an architectural opening comprises a transparent or translucent laminar element having a major, generally planar portion and at least one secondary portion inclined thereto which meets the said major portion at a surface discontinuity. A three dimensional surface shaping is thus formed which may represent cut glass or glazing bars or a stained glass window.

12 Claims, 4 Drawing Sheets

GLAZING ELEMENT

BACKGROUND OF THE INVENTION

The present invention generally concerns a glazing element comprising a sheet of transparent or translucent material intended in particular to be fitted in an architectural opening.

More specifically, the invention concerns glazing elements which imitate the appearance of stained or cut glass, and which may be incorporated in, for example, double glazed panels of doors or windows. The primary purpose of such elements is to make the doors or windows in which they are fitted more attractive, but they may equally be used to match new or replacement doors or windows with existing decorative panels.

Glazing elements are known which comprise a solid resin element occupying the entirety of the volume between the two layers of a double glazed cell.

Such known glazing elements have a number of disadvantages including the relatively large volume of material used in their manufacture, which increases the associated manufacturing costs, such costs being inevitably borne by the ultimate consumer.

In addition, the resin material used is light sensitive, with a marked tendency to deteriorate and become discoloured on prolonged exposure to light. This causes a deterioration in the quality of the glazing element manifested by way of a generally cloudy appearance and loss of clarity of the design. This is displeasing and is, in effect, a failure by the glazing element to fulfil its specific function as, once such deterioration has developed to any significant extent, the panel must be replaced if the desired appearance and attractiveness of the door or window is to be maintained. The need to replace panels for this reason leads to yet further unwelcome cost for the consumer, as well as the associated inconvenience.

OBJECT OF THE INVENTION

The object of the present invention is to overcome at least the majority of the above disadvantages.

SUMMARY OF THE INVENTION

According to one aspect of the present invention there is provided a glazing element for an architectural opening, comprising:

- a transparent or translucent laminar element having a major, generally planar portion, and
- at least one secondary portion inclined thereto which meets the said major portion at a surface discontinuity, wherein said at least one surface discontinuity simulates the appearance of a glazing feature and wherein said laminar element is adapted to be fitted between two sheets of a double glazed cell.

Preferably, the laminar element is in the form of a sheet of plastically deformable material.

Using a single sheet of material instead of a solid resin insert, as used in the known glazing elements, allows manufacturing costs to be reduced as a direct result of the reduced material costs. Such savings may be passed on to the purchaser which is an undeniable advantage.

A further aspect of the glazing element according to the invention is that the at least one surface discontinuity may be obtained by application of the known and widely used technique of vacuum forming which, being so well known, is not described in the present description. The technique is sufficiently flexible to allow a wide range of designs of varying complexity to be produced.

The at least one surface discontinuity obtained in this way may be such as to simulate the appearance of cut glass. Depending on the complexity of the design, different glazing elements will have different numbers of secondary portions inclined to the major portion of the laminar element, and the angle of inclination will itself depend on the desired appearance. A greater angle of inclination will be obtained where "sharper" cuts are intended to be represented, and vice versa. Having cut glass panels in doors, windows and the like is desirable, but genuine cut glass panels tend to be very expensive. Fitting the glazing element according to the invention into such doors, windows and the like can greatly enhance their appearance without the expense of fitting genuine cut glass panels.

Alternatively, the said at least one surface discontinuity may be such as to imitate glazing bars such as those found in, for example, Georgian-style windows and the like, in order to simulate the appearance of such windows. If desired, the surface discontinuity or discontinuities may be painted or filled so as further to enhance the appearance of the insert.

According to a yet further aspect of the present invention, the laminar element used may be a material which is resistant to deterioration upon exposure to ultra-violet light. By using such a material, the glazing element is not susceptible to, or is at least better able to withstand the structural and therefore visual deterioration experienced by many plastics and many other materials, in particular the resins used to make known glazing elements.

This lack of or reduced sensitivity to ultra-violet light overcomes one of the major disadvantages associated with the known glazing inserts, namely, the loss of both the clarity of the design and its pleasing decorative appearance caused by the light-induced discolouration described above of the resin insert.

Using the film resistant to ultra-violet light-caused deterioration therefore means that the glazing element according to the invention retains its original appearance and is thus able to fulfil its specific function for longer. This is obviously beneficial to the consumer particularly in economic terms as it will not be necessary to replace the panel for reasons relating to ultra-violet light-induced deterioration in quality, as well as in terms simply of the longer period of enjoyment of the decorative insert.

Of course, it is not essential that such film is used for the glazing elements if, for example, the anticipated life span of the panels in which the elements are fitted is not important, or where it is not necessary that their appearance remains unaltered. Similarly, where the decorative inserts are to be used where exposure to light is unlikely to be a problem such as, for example, in artificially (or dimly) lit environments, there would be no particular need or benefit in using an ultra-violet light-insensitive material.

A yet further aspect of the glazing element according to the present invention is the possibility of using different coloured materials in the form of pigments or pigmented materials. The use of colour simulates the appearance of stained glass, and may be used either alone in the glazing element or in combination with the aforesaid vacuum forming technique, which can further enhance the attractiveness of the glazing elements. Furthermore, a wider variation in the designs which may be produced will consequently be available, which is beneficial in offering greater customer choice.

Where the appearance of stained glass is desired, the pigments or pigmented materials may be incorporated in or applied to the insert after it has been vacuum formed to obtain the desired shape.

Alternatively, the desired pigments or pigmented materials and designs material used for the glazing insert may be incorporated in or applied to the insert before it is vacuum formed.

It is furthermore possible to use a genuine stained glass window as a mold in the vacuum forming of the laminar element. This will allow an accurate reproduction of the design on the original window to be obtained, to which pigment or pigmented material is then applied, or in which it is incorporated, by means of painting, staining and the like so as to match the colours of the original window. Different coloured pigments or pigmented materials may, of course, be used if it is not desired to match the colours of the original window.

Glazing inserts formed in this way have a number of applications. For example, they may be used to support the existing stained glass window used to form the glazing insert, or they may replace the original window if, for example, it is fragile and would be better preserved elsewhere.

Further advantages of the glazing elements according to the invention arise from the use of a single layer of material, including the resulting lightness of the glazing element. Its lightness means that it is able to be fitted into a double glazing panel without the need to add further support or reinforcement to the panel, and also adds to the ease of handling and fitting of the panel.

Other features and advantages of the invention will be described hereinafter with specific reference to the following drawings.

DESCRIPTION OF THE PREFERRED EMBODIMENTS

Figure 1:
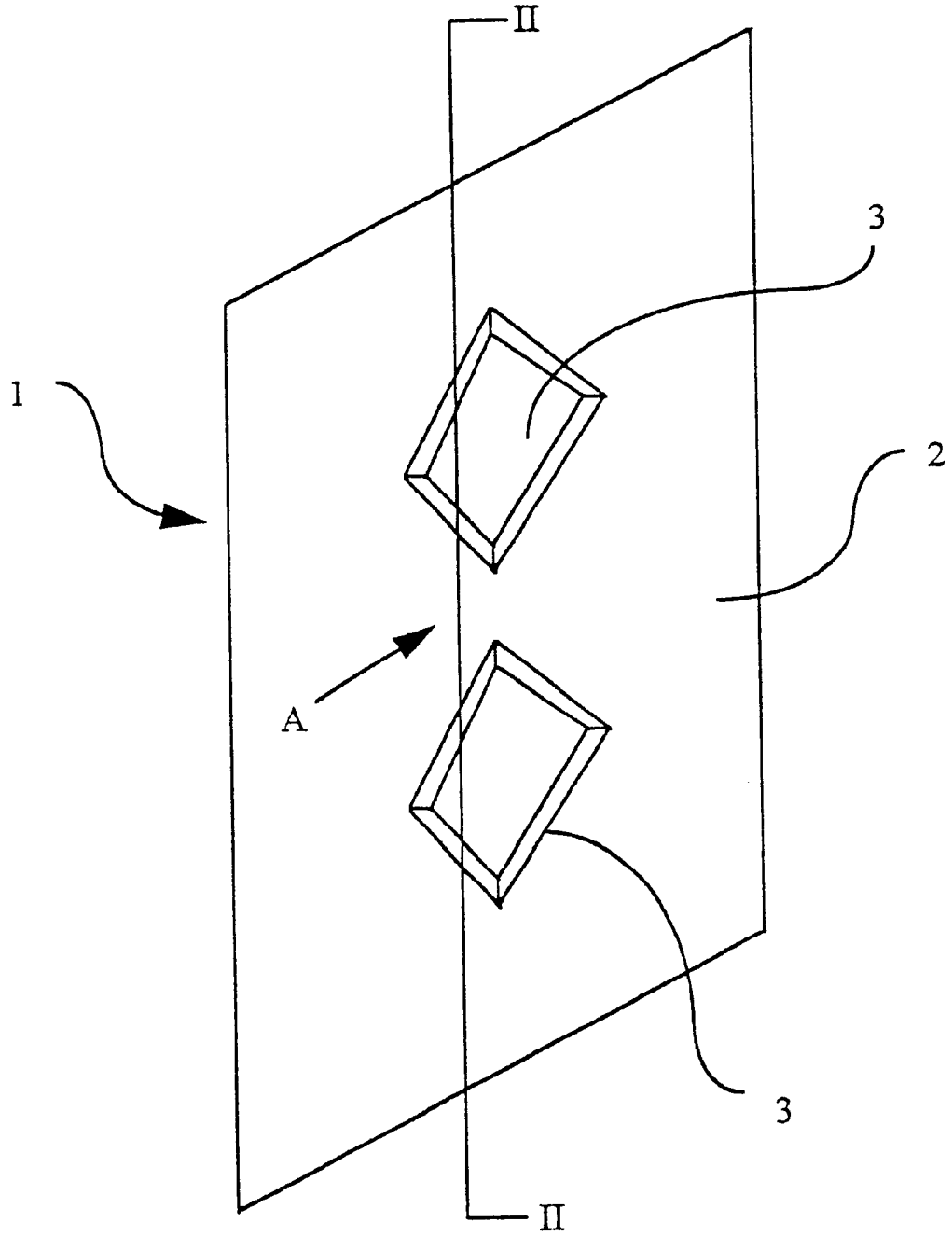
FIG. 1 is a front view of a glazing element according to the invention.

With reference to the drawings, the reference numeral 1 generally indicates a glazing element according to the invention, formed from a transparent or translucent laminar element 2 which has surface formations produced, for example, by vacuum forming. The laminar element may be a sheet of plastically deformable material and can, if desired, be a light-insensitive material such as a film which is resistant to deterioration on exposure to ultra-violet light.

Decorative portions of the glazing element 1 which imitate the appearance of cut glass are indicated 3. In the example illustrated in FIGS. 1, 3 and 4, the decorative portions are rhomboids, but may, of course, take any desired shape.

Figure 2:
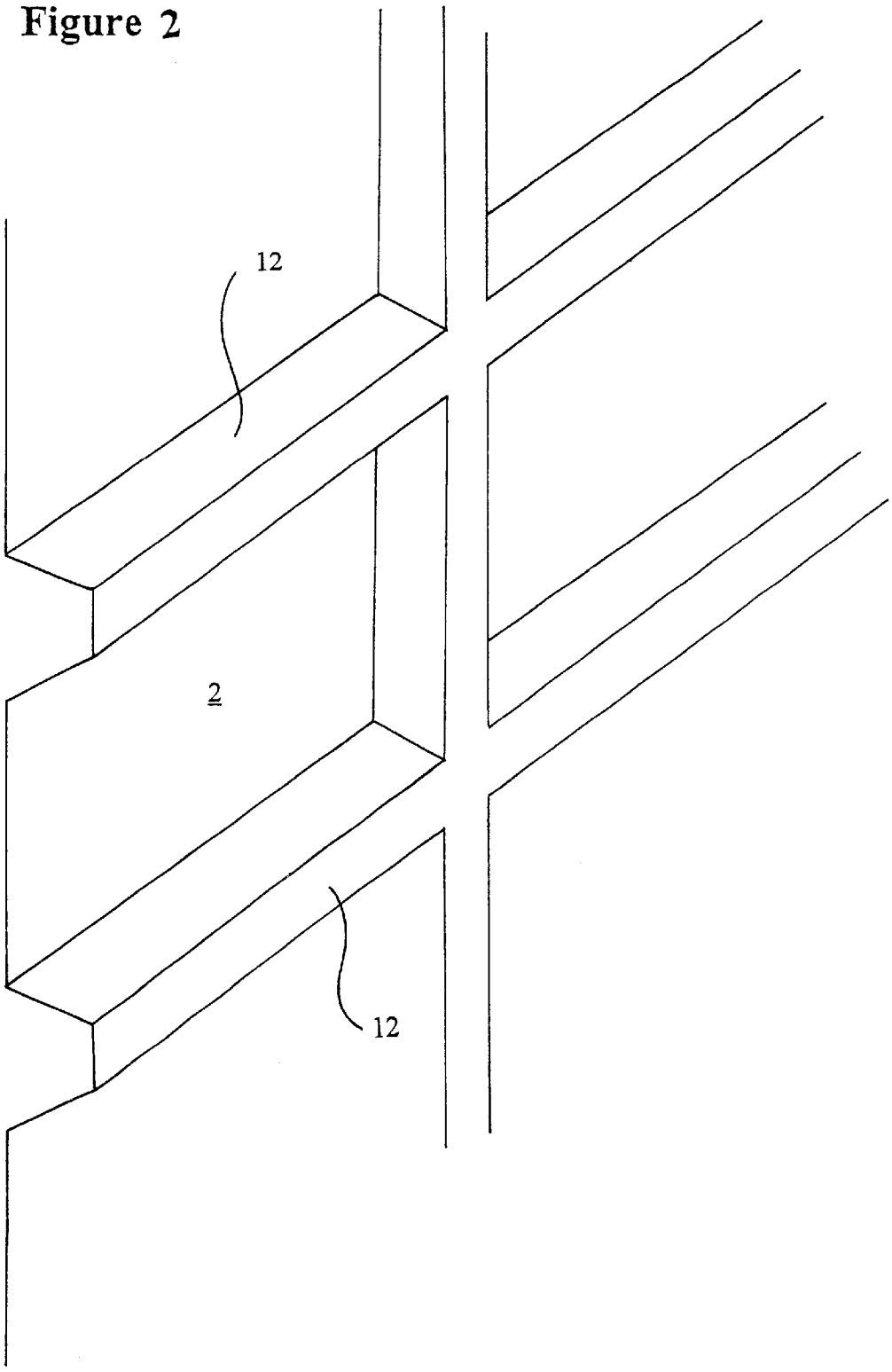
FIG. 2 is a perspective view of a different embodiment of the glazing element according to the invention, in which the glazing element simulates the appearance of a Georgian-style window.

For example, FIG. 2 illustrates an alternative embodiment of the glazing element 1 according to the invention which has channels which imitate the appearance of glazing bars 12, such as those seen in old-style windows. The hollow side of each channel represents a glazing bar 12 which may be painted or filled as desired. The glazing element 1 is thus able to simulate the appearance of such windows, and the conformity in appearance of the glazing insert with the original windows mean that replacement glazing inserts may be produced which are appropriate to the particular architecture of the building for which they are intended.

The general dimensions of the glazing element 1 may be varied according to its intended destination.

Figure 3:
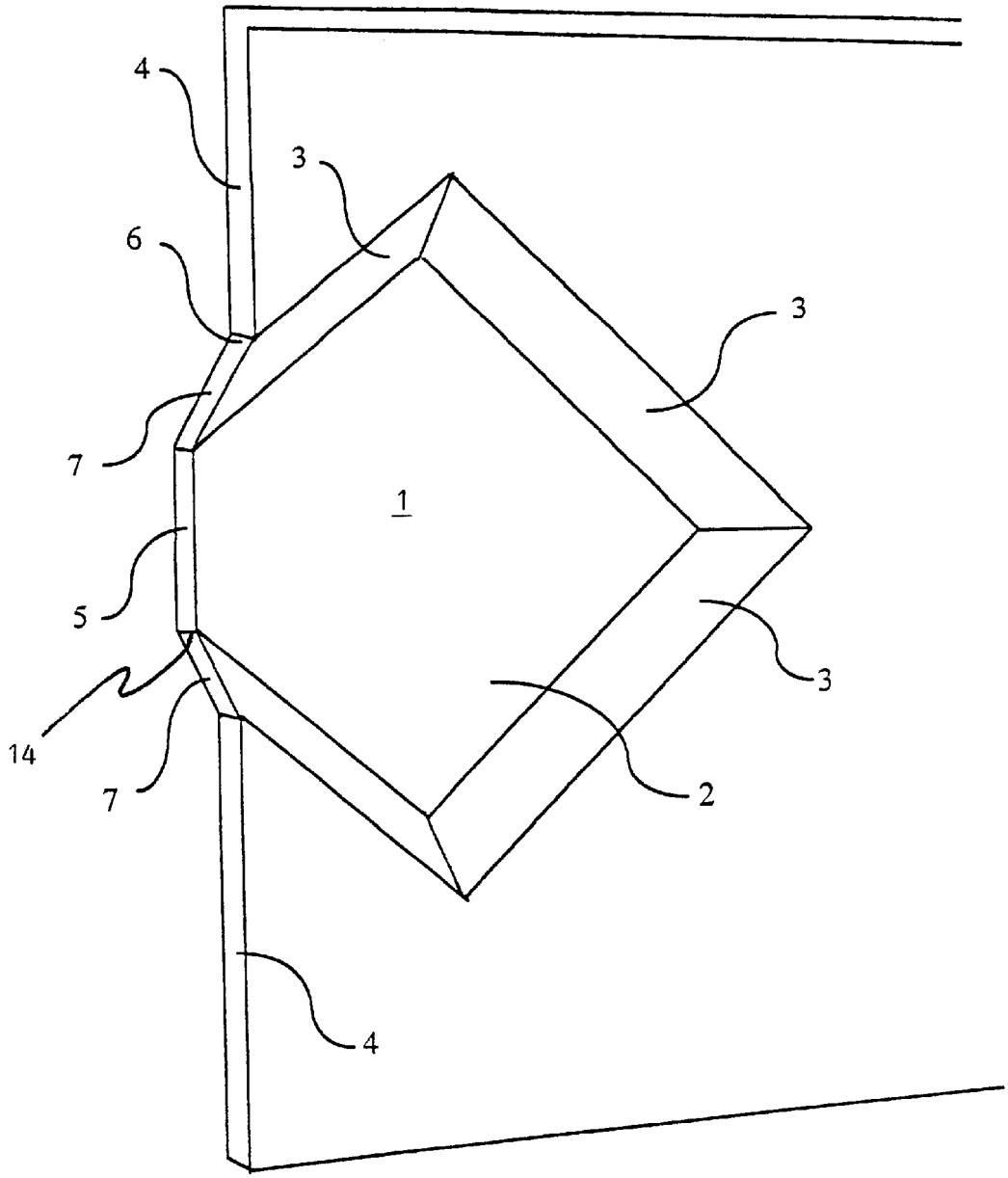
FIG. 3 is a section of the glazing element of FIG. 1 in the direction of the arrow A, taken on the line II—II of FIG. 1.

FIG. 3 shows the glazing element 1 of FIG. 1 in cross section. The laminar element 2 has a substantially planar major first portion 4 and a minor first portion 5 parallel to but offset from major first portion 4. The minor first portion 5 represents a recessed portion on the laminar element 2 which, in this particular example, is rhomboid in shape.

The recessed or decorative minor first portion 5 is obtained by applying the known technique of vacuum forming. This portion is connected to the major first portion 4 by means of inclined second portions 7, which represent the bevelled edges seen in genuine cut glass. The angle of inclination of the second portions 7 depends upon the desired shape of the decorative minor first portion 5 and overall appearance of the glazing element 1. The major first portion 4 meets the second portion 7 at a discontinuity represented by the sharp line 6 shown in FIG. 3. Likewise the second portions 7 meet the minor first portion 5 at discontinuities represented by the sharp lines 14 shown in FIG. 3. The opposite faces of each portion of the glazing element are parallel to one another.

Figure 4:
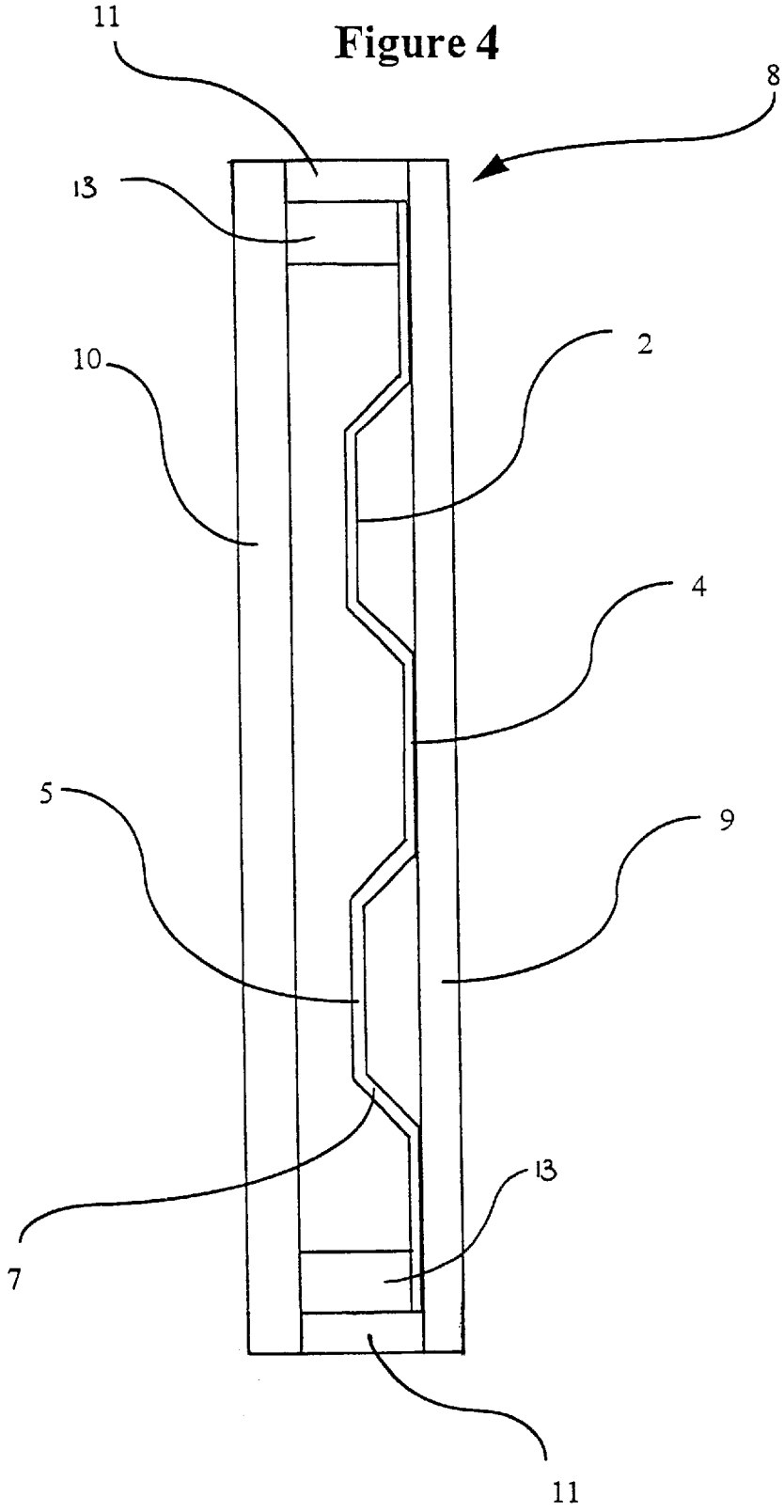
FIG. 4 is a horizontal cross-section (not to scale) of a glazing element according to the invention in place between the two layers of a double glazing cell.

FIG. 4 shows a cross section of the glazing element 1 according to the invention in place in a double glazing panel generally indicated 8. The side profile of the laminar element 2 can be seen, with the major first portion 4 of the laminar element 2, the decorative minor first portion 5 and the inclined second portions 7 as described above.

The double glazing panel 8, which may, for example be intended for a door or window, and which is of known construction, includes two sheets 9, 10 of glass or other glazing material. These sheets 9,10 are held at a predetermined distance from one another by known spacer bars 13 positioned along their facing inner edge portions.

The laminar element 2 is positioned between the two glazing sheets 9,10 before the double glazing panel 8 is assembled, with its major first portion 4 close to or in contact with one of the glazing sheets 9, usually the sheet intended to present the decorative appearance. This arrangement is obtained by positioning the spacer bar 13 between the laminar element 2 and other glazing sheet 10 such that the laminar element 2 is held in contact with the glazing sheet 9. The double glazing panel 8 including the laminar element 2 glazing sheets 9, 10, and spacer bars 13 is then sealed in the usual known way using a standard unit sealer 11.

The laminar element 2 is a plastically-deformable sheet, and is generally approximately 0.5 mm thick. This may, of course, be varied according to the effect desired, but substantially thicker sheets tend not to be used so as not to compromise the effectiveness of the vacuum forming.

A light-insensitive material such as film which is resistant to deterioration on exposure to ultra-violet light may be used for the laminar element 2. Using such a material avoids the situation in which there is a noticeable deterioration in the visual appearance of the glazing element 1 caused by a breakdown in its structure on prolonged exposure to ultra-violet light. Such deterioration is a major problem in known glazing elements, and can develop to such an extent that the glazing element 1 must actually be replaced if the pleasing decorative appearance of the glazed panel is to be preserved. Using a material which does not show such deterioration therefore substantially removes any need to replace the glazed panel for this reason, and reduces the cost to the purchaser.

Where, of course, the glazing element 1 is to be fitted in an environment where exposure to ultra-violet light is unlikely to be a problem such as, for example, in an artificially or dimly lit environment, or where the expected life span of the element 1 is not sufficiently long for a deterioration in appearance to arise, there would be no benefit in using an ultra-violet light-insensitive material for the laminar element 2.

Pigments or pigmented materials may be incorporated in the laminar element 2 where the appearance of stained glass in the glazing element is desired. Naturally, coloured material and vacuum forming may be used together to give the appearance of both stained and cut glass on a single element or, if preferred, the glazing element 1 may incorporate just one of these decorative aspects.

The desired colours of the stained glass may be applied after vacuum forming is completed, by application or incorporation of the desired pigments or pigmented materials, for example, by painting or staining the appropriate areas of the glazing element 1.

Alternatively, the desired pigments or pigmented materials and designs may be incorporated in or applied to the laminar element 2 before vacuum forming, if desired.

If an accurate reproduction of the design of an existing stained glass window is required, then such a window may be used as a mold in the vacuum forming stage of the laminar element 2. Once vacuum forming is complete, the pigment or pigmented materials are incorporated in or applied to the laminar element to match the original window, or to produce a different colour-scheme, as desired.

Glazing elements 1 formed in this way may be used to support existing windows or, alternatively, they may be used in place of such windows, if, for example, the original stained glass window is particularly fragile and would be better preserved elsewhere.

What is claimed is:

1. A double glazing structure comprising a first, substantially flat, rigid sheet of glazing material, a second substantially flat, rigid sheet of glazing material, a laminar, flexible, glazing insert element of light transmitting material having first and second opposite faces, first portions of said first face lying substantially parallel to the general plane of said first and second substantially flat, rigid sheets of glazing material, second portions of said first face being inclined at an angle to said first portions said first and second portions of said first face meeting one another at discontinuities, first portions of said second face lying substantially parallel to said first portions of said first face and having a substantially corresponding shape and size thereas, second portions of said second face lying substantially parallel to said second portions of said first face and having a substantially corresponding shape and size thereas, said first and second portions of said second face meeting one another at discontinuities whereby the said glazing insert element represents cut glass when viewed from either side, means positioning said glazing insert element between said first and second sheets of glazing material, said positioning means comprising at least one spacer member between said glazing insert element and at least one of said first and second sheets of glazing material, and sealing means sealing around the perimeter of said first and second sheets of glazing material whereby the seal of glazing insert element in the space between them.

2. The glazing structure of claim 1, wherein said glazing insert element is a sheet of plastically deformable material.

3. The glazing structure of claim 1, wherein said first and second portions inclined to one another are obtained by vacuum forming.

4. The glazing structure of claim 1, wherein said glazing insert element is made from a material resistant to deterioration on exposure to ultra-violet light.

5. A double glazing structure which comprises a first, substantially rigid sheet of glazing material, a second, substantially rigid sheet of glazing material, a laminar, flexible, glazing insert element of light transmitting material having first and second opposite faces, first portions of said first face lying substantially parallel to the general plane of said first and second substantially flat, rigid sheets of glazing material second portions of said first face lying out of the plane defined by said first portions of said first face, first portions of said second face lying substantially parallel to said first portions of said first face and having a substantially corresponding shape and size thereas second portions of said second face lying substantially parallel to said second portions of said first face and having a substantially corresponding shape and size thereas, said first portions of at least one of said first and second faces, and said second portions of at least one of said first and second faces being colored whereby said glazing insert element represents stained glass when viewed from either side, means positioning said glazing insert element between said first and second sheets of glazing material, said positioning means comprising at least one spacer member between said glazing insert element and at least one of said first and second sheets of glazing material, and sealing means sealing around the perimeter of said first and second sheets of glazing material whereby to seal said glazing element in the space between them.

6. The glazing structure of claim 5, wherein said glazing insert element is a sheet of plastically deformable material.

7. The glazing structure of claim 5, wherein said first and second portions thereof are obtained by vacuum forming.

8. The glazing structure of claim 5, wherein said glazing insert element is made from a material resistant to deterioration on exposure to ultra-violet light.

9. The glazing structure of claim 5, wherein said first and second portions of said glazing insert element are colored by incorporation of a pigments.

10. The glazing structure of claim 5, wherein said at least one of said first and second faces of said first and second portions are colored by coating with a pigmented material.

11. A method of forming a double glazing structure comprising a first, substantially flat, rigid sheet of glazing material, a second substantially flat, rigid sheet of glazing material, a laminar, flexible, glazing insert element of light transmitting material comprising the steps of forming the insert element with a three dimensional surface having first and second opposite faces so that first portions of said first face lying substantially parallel to the general plane of said first and second substantially flat, rigid sheets of glazing material, second portions of said first face being inclined at an angle to said first portions said first and second portions of said first face meeting one another at discontinuities, first portions of said second face lying substantially parallel to said first portions of said first face and having a substantially corresponding shape and size thereas, second portions of said second face lying substantially parallel to said second portions of said first face and having a substantially corresponding shape and size thereas, said first and second portions of said second face meeting one another at discontinuities whereby the said glazing insert element represents cut glass when viewed from either side, positioning said glazing insert element between said first and second sheets of glazing material, said positioning comprising the step of placing at least one spacer member between said glazing insert element and at least one of said first and second sheets of glazing material, and sealing around the perimeter of said first and second sheets of glazing material whereby to seal said glazing insert element in the space between them.

12. A method of forming a double glazing structure comprising a first, substantially flat, rigid sheet of glazing material, a second substantially flat, rigid sheet of glazing material, a laminar, flexible, glazing insert element of light transmitting material comprising the steps of forming the insert element with a three dimensional surface having first and second opposite faces so that first portions of said first face lying substantially parallel to the general plane of said first and second substantially flat, rigid sheets of glazing material second portions of said first face lying out of the plane defined by said first portions of said first face, first portions of said second face lying substantially parallel to said first portions of said first face and having a substantially corresponding shape and size thereas second portions of said second face lying substantially parallel to said second portions of said first face and having a substantially corresponding shape and size thereas, coloring said first portions of at least one of said first and second faces and said second portions of at least one of said first and second faces whereby said glazing insert element represents stained glass when viewed from either side, positioning said glazing insert element between said first and second sheets of glazing material, said positioning comprising the step of placing at least one spacer member between said glazing insert element and at least one of said first and second sheets of glazing material, and sealing around the perimeter of said first and second sheets of glazing material whereby to seal said glazing element in the space between them.

* * * * *